US008602233B2

(12) United States Patent
Giraud

(10) Patent No.: US 8,602,233 B2
(45) Date of Patent: Dec. 10, 2013

(54) BOTTLE SHAPED CONTAINER WITH INTEGRATED SLEEVE

(75) Inventor: Jean-Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 1414 days.

(21) Appl. No.: 12/095,097

(22) PCT Filed: Dec. 1, 2006

(86) PCT No.: PCT/US2006/061528

§ 371 (c)(1),
(2), (4) Date: Nov. 12, 2008

(87) PCT Pub. No.: WO2007/065162

PCT Pub. Date: Jun. 7, 2007

(65) Prior Publication Data

US 2009/0166312 A1 Jul. 2, 2009

Related U.S. Application Data

(60) Provisional application No. 60/741,845, filed on Dec. 1, 2005.

(51) Int. Cl.
*B65D 25/14* (2006.01)

(52) U.S. Cl.
USPC ..... 215/211; 215/13.1; 206/519; 206/217; 220/62.13; 220/62.22; 62/56

(58) Field of Classification Search
USPC ..... 215/13.1, 12.1; 206/519, 217; 220/62.13, 62.22; 62/56
See application file for complete search history.

(56) References Cited

U.S. PATENT DOCUMENTS

| | | | | |
|---|---|---|---|---|
| 2,084,056 A | | 6/1937 | Costello | |
| 2,849,144 A | * | 8/1958 | Southwell | 220/4.01 |
| 4,783,056 A | | 11/1988 | Abrams | |
| 4,812,116 A | | 3/1989 | Abrams | |
| 5,419,436 A | * | 5/1995 | Powell | 206/519 |

(Continued)

FOREIGN PATENT DOCUMENTS

| | | |
|---|---|---|
| CH | 87944 | 1/1921 |
| FR | 2704842 | 11/1994 |

OTHER PUBLICATIONS

European Search Report dated Jan. 12, 2010 for counterpart European Patent App. No. 06846443.7.

*Primary Examiner* — Anthony Stashick
*Assistant Examiner* — Cynthia Collado
(74) *Attorney, Agent, or Firm* — Greenberg Traurig, LLP

(57) ABSTRACT

A bottle-shaped container comprises at least three components. The first component is injection molded, has a desired shape, side walls, an opening at a top and a neck portion that connects the side walls to the top. The ratio of a diameter of the opening to a largest length of the inside wall is no greater than 0.75. The second component is a sleeve that abuts the inside side walls. The sleeve comprises side walls and a bottom section. An outside portion of the sleeve is fixed to inside side walls by a notch or lip located at an inside portion of the neck. The third component is a bottom that abuts an outside portion of the bottom section of the sleeve. A portion of each end of bottom is fixed to a portion of an undercut of a bottom of the bottle side walls.

14 Claims, 2 Drawing Sheets

(56) References Cited

U.S. PATENT DOCUMENTS

| | | | | | |
|---|---|---|---|---|---|
| 5,573,141 | A | * | 11/1996 | Chen | 62/457.3 |
| 5,653,362 | A | * | 8/1997 | Patel | 222/156 |
| 5,911,937 | A | | 6/1999 | Hekal | |
| 5,954,217 | A | * | 9/1999 | Brkovic et al. | 220/62.13 |
| 6,080,350 | A | | 6/2000 | Hekal | |
| 6,124,006 | A | | 9/2000 | Hekal | |
| 6,130,263 | A | | 10/2000 | Hekal | |
| 6,174,952 | B1 | | 1/2001 | Hekal | |
| 6,214,255 | B1 | | 4/2001 | Hekal | |
| 6,221,446 | B1 | | 4/2001 | Hekal | |
| RE37,676 | E | | 4/2002 | Abrams | |
| 7,198,171 | B2 | * | 4/2007 | Liu | 220/759 |
| 2007/0172555 | A1 | * | 7/2007 | Salice | 426/106 |

* cited by examiner

BOTTLE SHAPED CONTAINER WITH INTEGRATED SLEEVE

RELATED APPLICATIONS

This application is a national phase filing under 35 U.S.C. 371 of International Application No. PCT/US2006/061528 filed on Dec. 1, 2006, which claims the benefit of U.S. Patent Application No. 60/741,845 filed on Dec. 1, 2005, the entirety of which are hereby incorporated by reference in their entirety for all purposes.

BACKGROUND OF THE INVENTION

Many pharmaceutical and nutraceutical products are packaged in bulk containers. Conventionally, these containers are bottle-shaped having substantially cylindrical sides. The bottles are typically manufactured by a process of injection blow molding. In this process, an injection molded preform is formed. Next the preform is stretched (blow molded) over a mandrel to create the final bottle geometry.

Conventionally, the bottles used are composed of plastic, typically high-density polyethylene (HDPE). HDPE is used because of its good molding capabilities, low cost and high moisture barrier properties. Many products packaged in HDPE bottles are moisture sensitive. A drying agent (referred to as a desiccant) may be incorporated into the bottle during packaging. The desiccant, (e.g. silica gel, molecular sieve or a combination of both) is typically a granular material that is packaged in sachets or canisters. The canister or sachet is dropped into the bottle prior to product filling on the packaging line. The canisters and sachets are available in 1-gram, 2-gram and 3-gram units.

There are disadvantages with the canister or sachet. For example, when placed in a bottle, the desiccant canister or sachet can interfere with product filling. The canister or sachet can cause the product (i.e., a tablet or capsule) to pyramid during filling causing the product to overflow the bottle. For products that require a large quantity of desiccant, the loose canisters and sachets may compete for volume in the package. The desiccant makes it more difficult for the user to access the product. In many cases, the users remove the desiccant from the bottle immediately after opening. Thus, once removed, there is no means to remove moisture from the bottle during product use. This can degrade the product during use. Because the desiccant canister or sachet is loose in the package, the desiccant can be mistakenly ingested by the user.

SUMMARY OF THE INVENTION

In one embodiment, the present invention comprises a bottle-shaped container comprising at least three components, wherein the first component is injection molded, composed of a desired shape and comprises at least side walls, an opening at a top and a neck portion that connects the side walls to the top; the ratio of a diameter of the opening to a largest length of the inside wall of the bottle is no greater than 0.75; wherein the second component is a sleeve that abuts at least a portion of the inside side walls of the bottle, the sleeve comprises side walls and a bottom section, an outside portion of the sleeve is fixed to at least a portion of inside side walls of the bottle by a notch or lip located at an inside portion of the neck; and wherein the third component is a bottom that abuts an outside portion of the bottom section of the sleeve, a portion of each end of bottom is fixed to a portion of an undercut of a bottom of the bottle side walls.

BRIEF DESCRIPTION OF DRAWINGS

A more complete appreciation of the present invention and many of the attendant advantages thereof will be readily understood by reference to the following description was considered in connection with the accompanying drawings in which.

Figure 1:
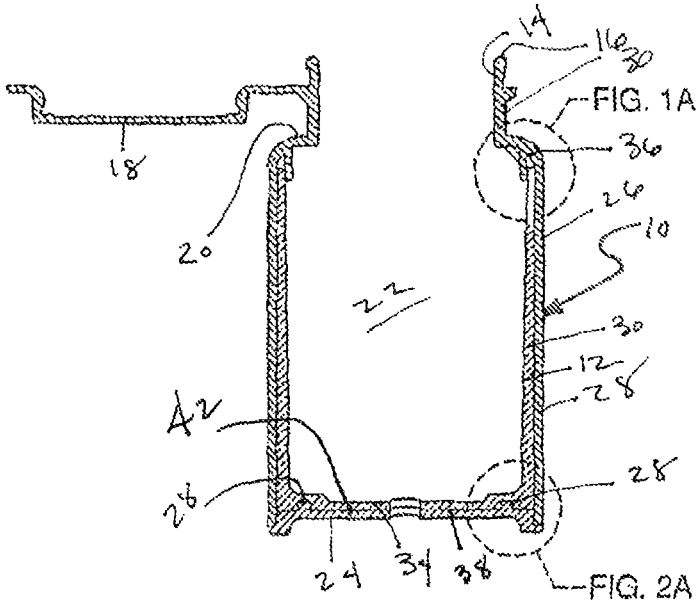
FIG. 1 is a cross-sectional view of one embodiment of the bottle-shaped container with liner of the present invention.
Figure 1A:
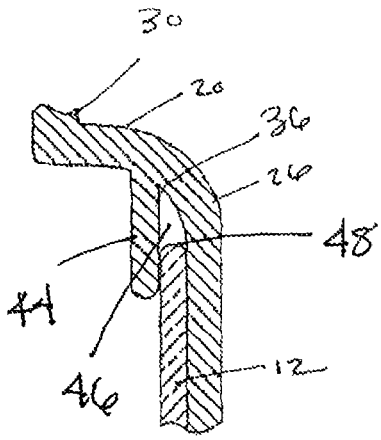
FIGS. 1A and 2A are blow-ups of one embodiment of the present invention of the FIG. 1.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various embodiments and features thereof.

DESCRIPTION OF EMBODIMENTS OF PRESENT INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the present invention is a bottle-shaped container 10 that is manufactured with a sleeve 12 that lines interior surfaces of the container 10. In one example, the sleeve 12, composed of plastic, may be composed of an active agent (e.g. desiccant) mixed with a plastic (e.g. desiccant entrained plastic). The desiccant entrained plastic sleeve reduces or eliminates the need for a separate desiccant canister or sachet. One example is a three component composition is the compositions and methods disclosed in one or more of the following U.S. Pat. Nos. 5,911,937, 6,214,255, 6,130,263, 6,080,350 and 6,174,952, 6,124,006, and 6,221,446. Another example is a two component mixture of active agent and plastic.

In one embodiment, of the process of making the present invention is manufactured in a multi-step injection molding process. For example, this process may incorporate 2-shot molding and include in-mold assembly.

In yet another embodiment, the shape of the bottle-shaped container 10 of the present invention can be any desired shape. For example, the bottle-shaped container 10 can be cylindrical or substantially cylindrical. In another example, the bottle-shaped container can be non-cylindrical bottle geometries (i.e., rectangular, square, oblong, oval). Incorporated in the desired shape of the bottle-shaped container 10 is a sleeve 12 that has substantially the same shape and dimensions of the interior surface of the container. In yet another embodiment, the top opening 14 of the bottle-shaped container 10 is less than the overall bottle-shaped container 10 width (or diameter).

In a further embodiment, the bottle-shaped container 10 comprises the following elements:

A Closure Region 16 with a diameter that is less than the overall bottle-shaped container 10 width. The closure region may be finished with a threaded opening (to support a traditional screw-top closure with a foil seal) or plug-type stopper closure. Alternative, the bottle-shaped container 10 may be molded with an integral flip-top closure 18. The flip-top provides a substantially moisture-tight re-sealable closure for the bottle-shaped container 10.

A Neck (or transition) Region 20—location where the bottle-shaped container 10 width transitions from the maximum width to the closure region width.

Product Region 22—the location defined by the maximum bottle-shaped container 10 width—the area of the bottle-shaped container 10 that is filled with product.

Sleeve 12—a separate molded component that lines the interior surface of the bottle-shaped container 10. The sleeve 12 may contain an active agent (e.g desiccant, oxygen absorber, releasing agent) or may be a material that is most suitable as a product contact surface.

Bottom 24—a separate component that is molded onto the bottom of the bottle-shaped container 10 after the sleeve 12 has been inserted. The formed bottom 24 closes off the bottom of the bottle-shaped container 10, creating a sealed end.

In one embodiment, the bottle-shaped container 10 with the integrated sleeve 12 supports a standard screw-top closure, stopper closure or an integral flip-top lid closure 18. In one example, the flip-top closure 18 is molded concurrently with the bottle-shaped container 10. In a specific example, the flip-top lid 18 creates a substantially moisture-tight resealable closure by closing the lid 18 during the molding process. Examples of flip-top lids designs are described in U.S. Pat. Nos. Re 37,676, 4,812,116, and 4,783,056, all of which are incorporated herein by reference. In another example, by closing the flip-top lid 18 in the mold, the sleeve 12 containing an active agent is protected from the ambient environment without additional protective packaging (i.e., barrier bag).

In one example, the sleeve 12 can be made from a variety of materials such as 3 Phase Active-Polymers, barrier or non barrier plastics depending on the requirements of the container 10. In one specific example, barrier plastics may include, but are not limited to, polyvinyl chloride, polyethylene vinyl acetate and poly vinylidene chloride. In another specific example, non-barrier thermoplastic materials may include, but are not limited to, polystyrene, polyester terephthalate, low-density polyethylene, polypropylene, polybutylene, metallocene catalyzed polyolefins and poly maleic anhydride.

In another embodiment that includes one or more active agents, the active agents may be blended into polymers suitable for injection molding. For example, the amount of active agents in the polymer can range from about 10% to about 70% by weight of the polymer. The total capacity of the active agent can be customize by: (1) varying the sleeve thickness, and/or (2) varying the active agent loading in the polymer.

In one example, the active agents are blended into the polymer by using a compounding process. In a further example, an extruder (e.g., Leistriz Twin-Screw Extruder) can be used to compound the active polymer. In yet another example, the blended material is formed into strands and cut into regular shaped pellets suitable for use in an injection molding process.

Suitable types of active agents (or contact surfaces) include but are not limited to:

Desiccants—e.g. molecular sieves, silica gel, clays, calcium carbonate, etc.

Oxygen absorbers

Odor absorbers

Inert product contact surface—e.g., Teflon—Packaging materials may absorb (or scalping) flavors or active compounds from the product. Specific materials, such as Teflon have been found to be beneficial at minimizes scalping.

Anti-Microbial Agents

The sleeve 12 is designed to line the interior surface of the bottle-shaped container 10. In another example, the sleeve 12 can also be designed and molded with compartments (or partitions) to separate product in the bottle-shaped container 10. These compartments may serve several functions, which include but are not limited to: (1) product cushioning—reducing product (tablet) movement in the package and/or (2) compliance—the compartments may be used in conjunction with instructions (or features) on the bottle to insure that the user takes the product at the prescribed time.

In one embodiment, the bottle-shaped container 10's top opening 14 size area is no more than 75% of the cross sectional area of the Bottle Product Region 22 (the overall bottle width or outside diameter). In one example, during the second injection, the sleeve 12 is supported by a mold core that fits though the Bottle Opening 14. In another embodiment, the upper portion of the bottle-shaped container 10 has features to retain the Sleeve 12 and prevent the Sleeve 12 from moving during the injection of the bottom 24. For example, clearance between the bottle and the sleeve is maintained in a retaining feature. In another example, the position of the Sleeve 12 in the bottle-shaped container 10 is controlled by a supporting core through the bottle opening 14, not by the mechanical fit between the bottle-shaped container body 26 and sleeve 12.

The bottle-shaped container 10 top or container body 26 and bottom 24 can be made of a variety of polymers depending on the specific requirements of the container 10. Suitable materials include, but are not limited to, barrier plastics that may include, for example, polyvinyl chloride, polyethylene vinyl acetate and poly vinylidene chloride. Suitable non-barrier thermoplastic materials may include, but are not limited to, polystyrene, polyester terephthalate, low-density polyethylene, polypropylene, polybutylene, metallocene catalyzed polyolefins and poly maleic anhydride.

In another embodiment, a process that molds the Sleeve 12 in the same mold as the container body 26 may contain an undercut feature that is used to form an undercut 28 on the outside bottom surface of the Sleeve 12 so that it is removed from the internal core in the mold when opening. This aids the transfer to the Bettle-Top container body 26. The undercuts 28 are subsequently filled in when the Bottom 24 is formed.

The present invention may have one or more of the following advantages: can improve product stability during shelf life and use life; create a substantially impenetrable barrier—since the sleeve 12 lines the interior surfaces of the bottle-shaped container 10, the product can be well protected because the active agent in the sleeve 12 absorbs materials (i.e., moisture oxygen, etc.) before the materials reach the product; the desiccant (drying agent) is embedded into the sidewalls; the desiccant is not readily visible to the end user; eliminates loose desiccant in the package; the desiccant can not be easily removed; reduces the possibility of the desiccant being ingested; reduces the impact to existing packaging lines—the standard (non-desiccated) bottle-shaped container 10 and the bottle-shaped container 10 with integrated desiccant should be able to run on existing packaging line without changes; and/or can customize the amount of desiccant in the bottle-shaped container, based on the product and/or the climate zone. Moreover, the desiccant can be used to remove residual moisture in the product—the package can eliminate a process step.

The following illustrates one example of the present invention. It is understood that this is merely one example and is not meant to limit the invention to this illustration. This example uses a 2-shot injection molding with a 3-position rotary table. One mold cavity makes the inner lining (sleeve) 12, which may incorporate an active agent in the polymer. The second mold cavity forms the exterior bottle (or container body) 26. Polymers used for the container body include, but are not limited to: (1) HDPE and (2) Polypropylene. The following is a sequence of operation of the Manufacturing Process:

1. The mold closes in Position 1.

Step 1a—Exterior Bottle Cavity A: The mold injects polyethylene resin to form the flip-top lid 18 (or threaded closure) and body 26. The exterior base of the bottle-shaped container 10 is not formed at this time.

Step 1b—Sleeve Cavity B: Simultaneously with Step 1a, the mold injects a second polymer material into a separate mold cavity to form the bottle sleeve 12. The sleeve 12 creates an inner sidewall and an inner base.

2. The mold opens.

The body 26 is retained in Cavity A. The sleeve 12 is retained on the core of Cavity B.

3. The core side of the mold rotates 90 degrees to Position 2, so that the Cavity B core (that retains the sleeve 12) is positioned over Cavity A (that contains the exterior bottle w/o base.

4. The mold closes in Position 2; the sleeve 12 is mechanically transferred to the body 26.

5. The mold opens.

6. The core side of the mold rotates 90 degrees to Position 3.

7. The mold closes in Position 3 and the polyethylene resin is injected into the mold forming a sealed base 24 on the exterior bottle.

8. The mold opens

9. The flip-top lid 18 is closed on to the bottle-shaped container 10 (not required for screw-top closure)

10. The finished part is ejected from the mold; the core side of the mold and rotates 180 degrees back to Position 1.

The following illustrates another example of the present invention. It is understood that this is merely one example and is not meant to limit the invention to this illustration. This example uses a 2-position stack mold. The container 10 is made by a series of steps. One embodiment is to conduct these steps using a stack mold and a two shot molding machine. The series of steps are as follows—

Step 1—In the first position the polyethylene resin is injected into Cavity A making the Closure Region 16, Neck Region 20 and Product Region 22, referred to as the body 26. Simultaneously desiccant plastic is injected into Cavity B and the Sleeve 12 is molded on the opposite side of the stack mold. The Sleeve 12 has an open end and a closed end.

Step 2—the mold opens and the Sleeve 12 is transferred into position on the other side of the mold. Also during this step the mold rotates to the second position.

Step 3—The internal Sleeve 12 is inserted into the body with the open end towards the container opening, over a supporting core in the mold.

Step 4—The mold closes and the second injection of polyethylene occurs. The second injection creates the Bottom 24, and bonds to the body creating a substantially moisture tight seal, and locking the Sleeve 12 in place in the container 10. During the second injection of the first part, the first injection of the next container is occurring, so that each cycle produces as completed part.

Step 5—The mold opens and the Flip Top lid 18 is closed, creating a reclosable substantially moisture tight seal at the opening 14 of the container 10.

Step 6—The completed container 10 is ejected from the mold.

The following illustrates yet another example of the present invention. It is understood that this is merely one example and is not meant to limit the invention to this illustration. This example describes one method and sequence of steps to manufacture the container 10. The container 10 could be manufactured by variations on these steps such as the following.

In Step 1, the Sleeve 12 and the body 26 do not need to be injected simultaneously on the same injection molding machine. For example, two machines working in tandem where the body 26 and Bottom 24 are made on one machine, and the Sleeve 12 is made on a second machine and transferred to the first machine for insertion in step 3.

Other embodiments of the method include having each step carried out on a separate machine and transferring parts from one to another in the correct sequence, manufacturing the Sleeve 12 in advance and have it inserted into the mold, manufacturing the Sleeve 12 by means other than injection molding, such as blow molding, casting or machining, using the same material for the Sleeve 12 as the body 26 and Bottom 24. A further variation also encompasses Steps 2 and 3 is to use a mold where the Sleeve 12 is molded on the same face of the mold as the body 26 and an additional position is utilized to transfer the Sleeve 12 to the body 26. Another variation of Step 2 would be the movement between Position 1 and Position 2 can be a linear shuttling movement. Where Step 5 describes a Flip Top embodiment of the container 10, a variation of this process also is to use other types of reclosable openings such as threaded or plug seal. In another example, instead of closing the lid 18, the appropriate geometry on the body 26 is created by unthreading or striping out a mold component depending on the desired geometry.

Figure 2:
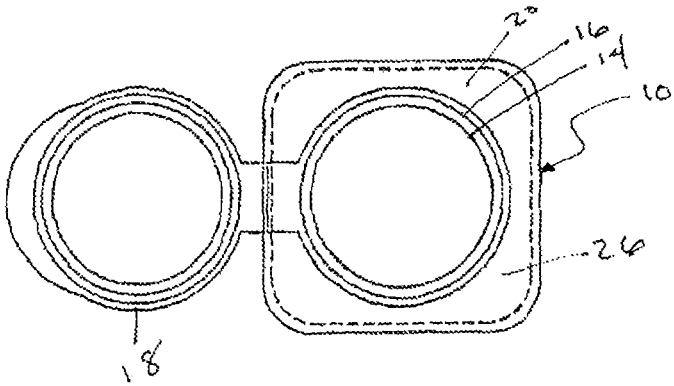
FIG. 2 is an overhead plan view of one embodiment of the bottle-shaped container with liner of the present invention in an opened position.
Figure 2A:
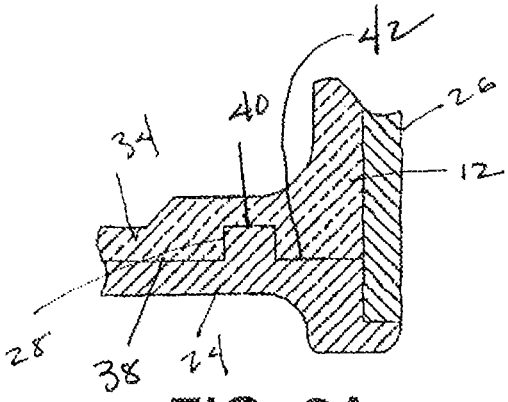
Figure 3:
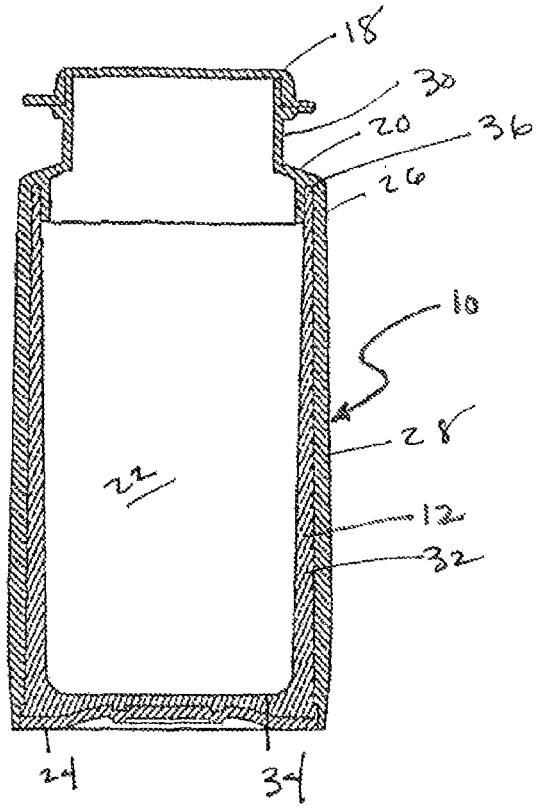
FIG. 3 is a cross-sectional view of one embodiment of the bottle-shaped container with liner of the present invention.
Figure 4:
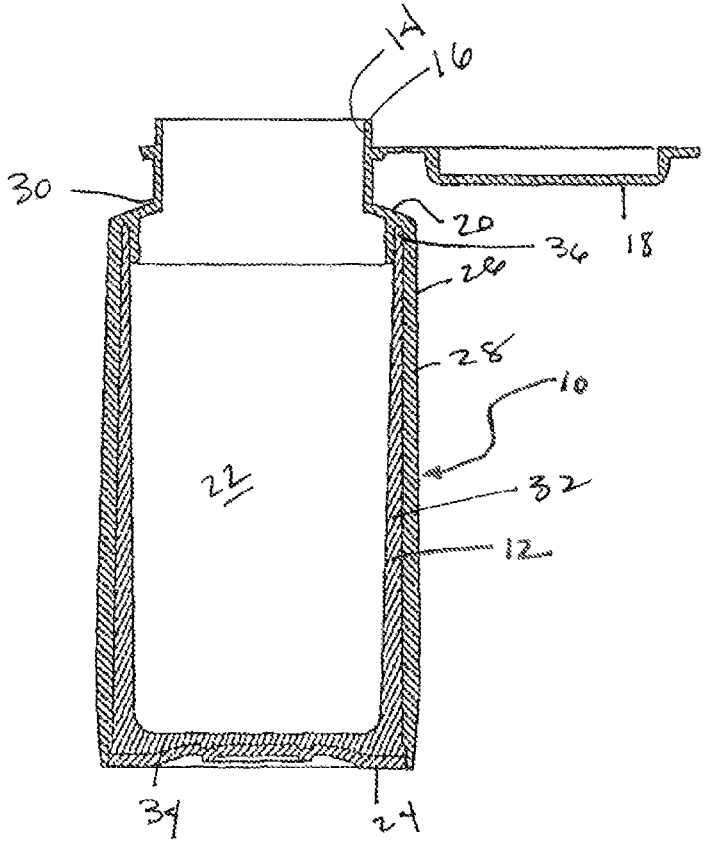
FIG. 4 is a cross-sectional view of one embodiment of the bottle-shaped container with liner of the present invention.

In yet another embodiment, the bottle-shaped container 10 comprises at least three components, wherein the first component 26 is a body portion 10 that is injection molded, composed of a desired shape and comprises at least side walls 28, an opening 14 at a top portion 30 and a neck portion 20 that connects the side walls 28 to the top portion 30; the ratio of a diameter of the opening 14 to a largest diameter of an inside side wall 28 of the bottle-shaped container 10 is no greater than 0.75; wherein the second component 12 is a sleeve 12 that abuts at least a portion of the inside side walls 28 of the bottle-shaped container 10, the sleeve 12 comprises side walls 32 and a bottom section 34, an outside portion of the sleeve 12 is fixed to at least a portion of inside side walls 28 of the body 26 by a notch or lip 36 located at an inside portion of the neck 20. In the embodiment shown, the notch or lip 36 is formed by a flange 44 that extends downwardly from the neck portion 20 on an interior of the first component 26. A channel 46 that receives an uppermost edge 48 of the sleeve 12 is defined between the flange 44 and the side walls 28. The third component 24 is a bottom 24 that abuts an outside portion of the bottom section of the sleeve 12, a portion of each end of bottom 24 is fixed to a portion of an undercut 28 formed on a bottom surface 38 of the sleeve 12. In the illustrated embodiment, the undercut 28 is formed as a groove 28 in the bottom surface 38 of the sleeve 12, and the bottom 24 comprises a projection 40 extending upward from a top surface 42 thereof. The projection 40 is received within the groove 28 in an interlocking manner, as shown in FIG. 2A, to affix the bottom 24 with the bottom section of the sleeve 12. In the embodiment shown, the entire top surface 42 of the bottom 24 abuts the entire bottom surface 38 of the bottom section of the sleeve 12.

Further examples include one or more of the following: desired shape is cylindrical or non-cylindrical shape; sleeve 12 that is make of desiccant plastic; sleeve 12 that is made of a material suitable as a product contact surface for the product; compartments in the sleeve 12 for cushioning or compliance; integral lid 18 attached by a hinge; sleeve 12 and/or Base 24 are injection molded; sleeve 12 that is made of oxygen scavenging plastic; sleeve 12 that is incorporates an anti-microbial agent in the plastic; sleeve 12 is manufactured by injection blow molding; and/or sleeve is manufactured by casting.

What is claimed is:

1. A bottle-shaped container comprising at least three components, wherein a first one of the components is injection molded, composed of a desired shape and comprises at least side walls, an opening at a top and a neck portion that connects the side walls to the top;

wherein a second one of the components is a sleeve that abuts at least a portion of the inside side walls of the first component, the sleeve comprises side walls and a bottom section, an outside portion of the sleeve is fixed to at least a portion of inside side walls of the first component by a notch or lip located at an inside portion of the neck portion; and wherein a third one of the components is a bottom that abuts an outside portion of the bottom section of the sleeve, a portion of each end of the bottom is fixed to a portion of an undercut formed on a bottom surface of the sleeve wherein the notch or lip defines a channel that receives an uppermost edge of the sleeve, and the notch or lip is formed by a flange that extends downwardly from the neck portion on an interior of the first component, and the channel is defined between the flange and the side walls.

2. The bottle-shaped container of claim 1 wherein desired shape is a non-cylindrical shape.

3. The bottle-shaped container of claim 2 wherein the sleeve is composed of a desiccant plastic.

4. The bottle-shaped container of claim 3 wherein sleeve that is composed of a material suitable as a product contact surface for the product.

5. The bottle-shaped container of claim 3 wherein the compartments in the sleeve is composed of a material that provides for cushioning.

6. The bottle-shaped container of claim 3 wherein the container comprises an integral lid attached by a hinge.

7. The bottle-shaped container of claim 3 wherein the sleeve and the base are injection molded.

8. The bottle-shaped container of claim 2 wherein the sleeve is composed of an oxygen scavenging plastic.

9. The bottle-shaped container of claim 2 wherein the sleeve is composed of an anti-microbial agent in the plastic.

10. The bottle-shaped container of claim 1 wherein at least one compartment in the sleeves is designed so as to function as package compliance.

11. The bottle-shaped container of claim 1, wherein the undercut formed on the bottom surface of the sleeve is a groove that receives a projection formed in a top surface of the bottom.

12. The bottle-shaped container of claim 11, wherein the groove and the projection are interlocking.

13. The bottle-shaped container of claim 1, wherein the entire top surface of the bottom abuts the entire bottom surface of the bottom section of the sleeve.

14. The bottle-shaped container of claim 1, wherein a ratio of a diameter of the opening to a largest length between opposite inside walls of the container is no greater than 0.75.

* * * * *